US009957966B2

(12) United States Patent
Chou

(10) Patent No.: US 9,957,966 B2
(45) Date of Patent: May 1, 2018

(54) INFLATOR

(71) Applicant: Wen-San Chou, Tainan (TW)

(72) Inventor: Wen-San Chou, Tainan (TW)

( * ) Notice: Subject to any disclaimer, the term of this patent is extended or adjusted under 35 U.S.C. 154(b) by 240 days.

(21) Appl. No.: 15/063,460

(22) Filed: Mar. 7, 2016

(65) Prior Publication Data

US 2016/0265541 A1 Sep. 15, 2016

(30) Foreign Application Priority Data

Mar. 11, 2015 (TW) ..... 104107791 A

(51) Int. Cl.

| | |
|---|---|
| ***F04B 39/06*** | (2006.01) |
| ***F04D 19/00*** | (2006.01) |
| ***F04B 35/04*** | (2006.01) |
| ***F04B 35/06*** | (2006.01) |
| ***F04B 39/12*** | (2006.01) |
| ***F04D 29/52*** | (2006.01) |
| *F04D 25/08* | (2006.01) |

(52) U.S. Cl.

CPC ..... *F04D 19/002* (2013.01); *F04B 35/04* (2013.01); *F04B 35/06* (2013.01); *F04B 39/06* (2013.01); *F04B 39/066* (2013.01); *F04B 39/121* (2013.01); *F04D 29/522* (2013.01); *F04D 25/082* (2013.01)

(58) Field of Classification Search

CPC ..... F04B 39/121; F04B 39/06; F04B 35/06; F04B 35/04; F04B 39/066; F04D 19/002; F04D 29/522; F04D 25/082

See application file for complete search history.

*Primary Examiner* — Peter J Bertheaud
*Assistant Examiner* — Dnyanesh Kasture

(57) ABSTRACT

An inflator includes a box and a compressor unit installed in the box. The box is composed of a cover and a base, which are respectively provided with upper and lower airflow-guiding members, which can quickly guide the air current generated by a cooling fan of the compressor unit to enter the motor's housing via two openings of the housing and to flow out of the motor's housing via downstream through holes of the housing, thus dissipating the heat generated by a rotor assembly in the motor, so that heat is not easy to accumulate in the motor, so that maximum power output of the motor can be achieved, and the performance and service life of the motor can be increased.

2 Claims, 7 Drawing Sheets

INFLATOR

(a) TECHNICAL FIELD OF THE INVENTION

The present invention relates to an inflator, which comprises a box and a compressor unit installed in the box, wherein the box is designed to allow the air current generated by a cooling fan of the compressor unit to quickly enter the motor's housing to dissipate heat generated therein, so that heat is not easy to accumulate in the motor's housing; therefore, maximum power output of the motor can be achieved, and the performance and service life of the motor can be increased.

(b) DESCRIPTION OF THE PRIOR ART

Air compressors are usually employed to inflate objects such as air cushions or tires. Generally, portable air compressors are manufactured in small size, so that they can be carried easily. Furthermore, a portable air compressor can be powered by a handheld DC power supply or a cigarette lighter socket in a vehicle. Conventionally, a portable air compressor employs a box to accommodate a compressor unit therein, wherein the compressor unit employs a motor to drive a piston body to conduct reciprocating motion in a cylinder to produce compressed air, which can be transferred to an object that needs to be inflated. In operation, heat may be accumulated in the box. Since a motor includes therein a rotor assembly, which contains an armature core formed by an iron core wound with enameled wire, a commutator, and a brush unit, heat is easy to accumulate in the motor's housing. The heat accumulated in the armature core may cause the brush unit to contain more carbon deposits, thus affecting the electrical circuit of the motor. Besides, high temperature resulting from the armature core may reduce the magnetic intensity of the magnets used in the motor. Thus, the performance of the motor can be reduced.

Currently, emergency repair kits, which employ a low-power motor, are used to repair punctured tires. However, in some countries, the Traffic Act stipulates that, when a punctured tire happens to a vehicle on a highway, the driver should repair the punctured tire within a specified period and should immediately drive away after the repair is completed to prevent rearward bump. Under these circumstances, for completing the repair as soon as possible, the motor of the compressor unit of an emergency repair kit should be operated at a higher speed. However, if heat accumulated in the motor's housing cannot be quickly taken away, the performance of the motor will decrease. Even worse, the enameled wire of the armature core will probably be damaged to cause a short circuit, and thus the motor may burn out.

In conventional inflators, a compressor unit and its motor are supported in a box through partitioning walls. However, the box is not structured to assist dissipating heat in the motor. Thus, the box is easy to accumulate the heat generated by the motor, and thus the performance of the motor can be reduced or the motor can be damaged.

SUMMARY OF THE INVENTION

One object of the present invention is to provide an inflator, which generally comprises a box and a compressor unit installed in the box. The box is composed of a cover and a base. The compressor unit includes a motor, which can be firmly supported in the box by upper and lower airflow-guiding members which are respectively provided at the cover and the base. The motor can rotate a cooling fan for generating an air current, which can be guided by the upper and lower airflow-guiding members to quickly enter the motor's housing via two opposite openings of the motor's housing and then to flow out of the motor's housing via downstream through holes of the motor's housing, thus taking away the heat generated by the rotor assembly in the motor. Thus, heat is not easy to accumulate in the motor, so that the performance and service life of the motor can be increased.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
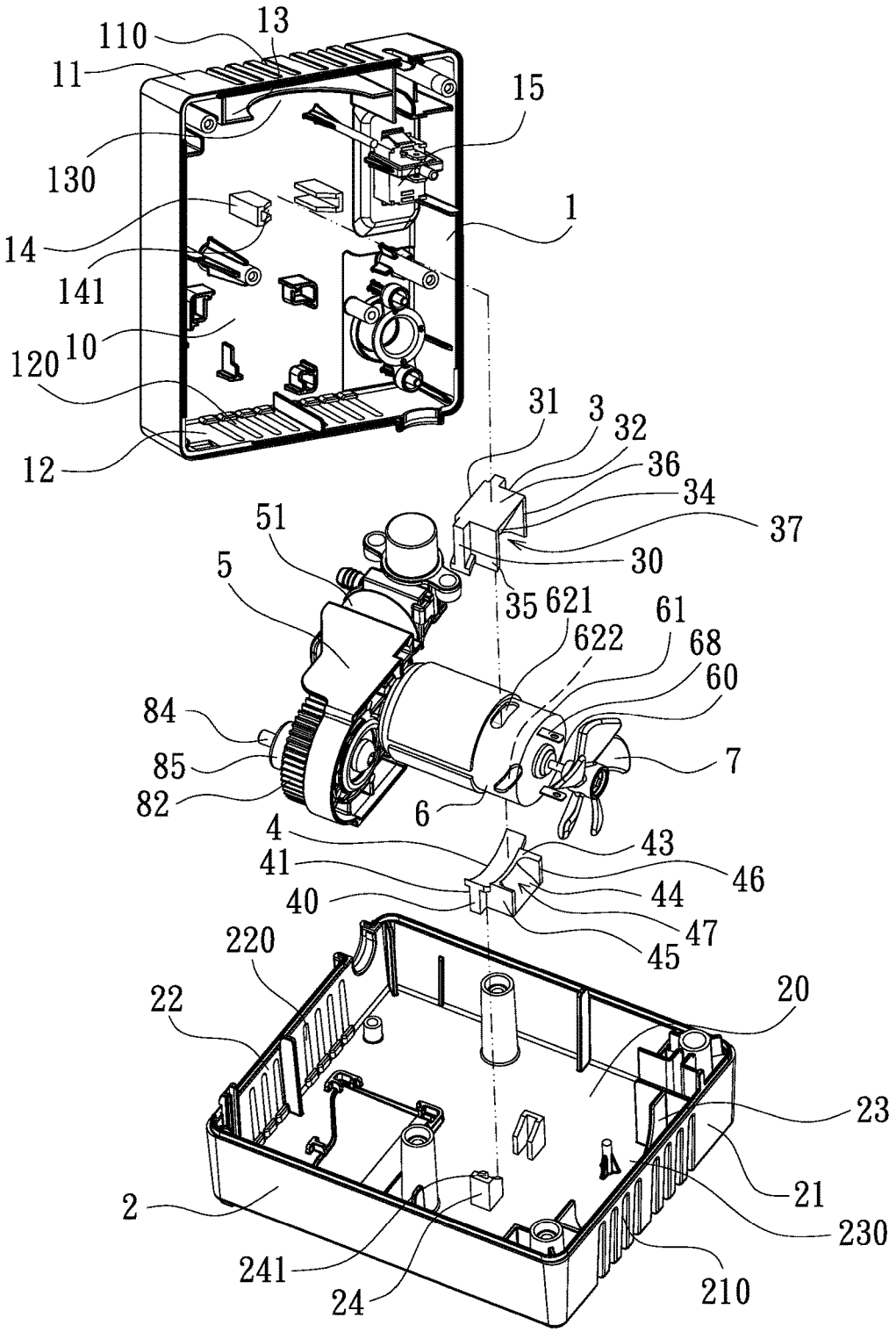
FIG. 1 shows an exploded view of an inflator according to one embodiment of the present invention, wherein the inflator generally includes a box being composed of a cover and a base, and a compressor unit.
Figure 2:
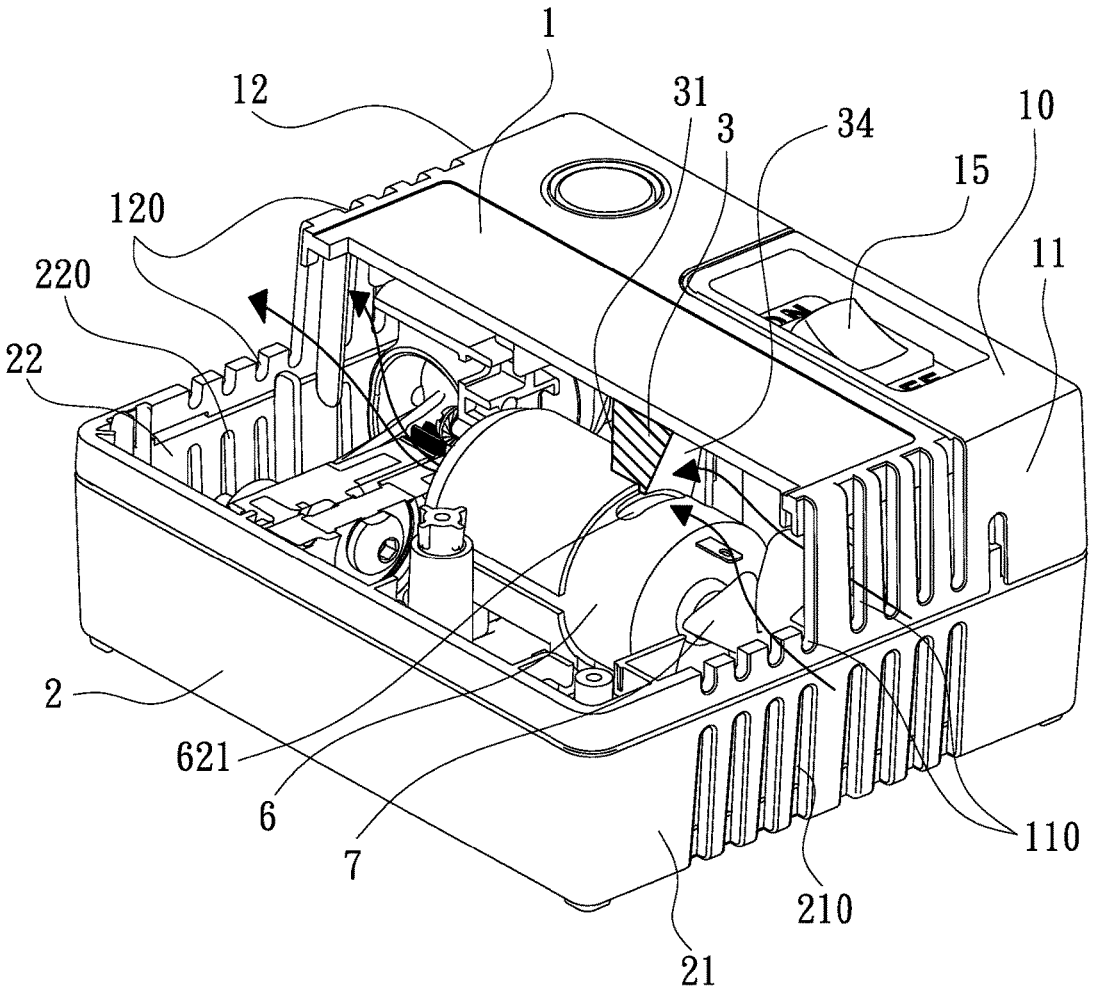
FIG. 2 shows a 3-dimensionally sectional view of the inflator.

Referring first to FIGS. 1 and 2, an inflator according to one embodiment of the present invention is shown, which generally includes a box and a compressor unit installed in the box, wherein the box is composed of a cover 1 and a base 2.

Figure 6:
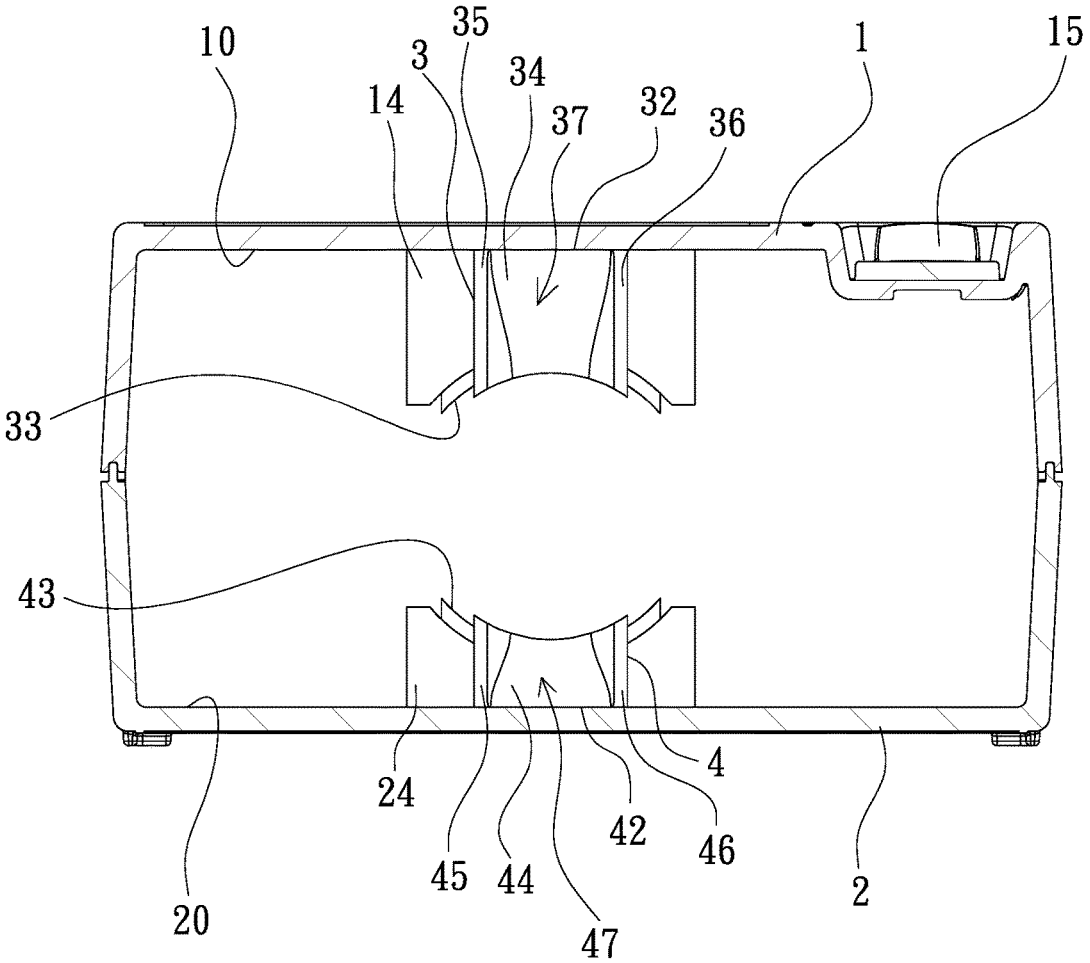
FIG. 6 shows a sectional view of the box.

As shown in FIG. 1, the cover 1, which has a rectangular board 10, a front wall 11 and a rear wall 12 opposite to the front wall 11, wherein the rectangular board 10 is installed with a switch 15 for starting or stopping the compressor unit. The front wall 11 of the cover 1 defines multiple first slits 110 to serve as an air entrance port, while the rear wall 12 of the cover 1 defines multiple second slits 120 to serve as an air exit port. The rectangular board 10 is provided with two opposite, upper fixing columns 14, each of which defines a channel 141, for engaging with an upper airflow-guiding member 3, which has an intercepting wall 31 of a predetermined height, two lateral walls 35, 36, a base plate 32, and a curved portion 33 (see also FIGS. 4 and 6). The two lateral walls 35, 36 respectively extend from two opposite sides of the intercepting wall 31, towards the front wall 11 of the cover 1. The intercepting wall 31 is farther to the front wall 11 of the cover 1 than its adjacent lateral walls 35, 36. The base plate 32 is formed between one end of the intercepting wall 31 and the lateral walls 35, 36. The curved portion 33, conforming to the curvature of the housing 61 of a motor 6 of the compressor unit, is formed opposite to the base plate 32. The upper airflow-guiding member 3 is formed with two opposite ribs 30, which respectively extend from the two lateral sides 35, 36 and are substantially perpendicular to the two lateral sides 35, 36. The two opposite ribs 30 can engage in the channels 141 of the two upper fixing columns 14 and can support the curved portion 33, so that the upper airflow-guiding member 3 can be fixed onto the cover 1, and the curved portion 33 thereof can be used to support the motor's housing 61 of the compressor unit. The upper airflow-guiding member 3 is engaged with the upper fixing columns 14 such that the base plate 32 thereof is brought in contact with the rectangular board 10 of the cover 1. An upper air guiding channel 37 is defined between the intercepting wall 31, the two lateral walls 35, 36, and the base plate 32 of the upper airflow-guiding member 3. An upper slant surface 34, which is formed between the intercepting wall 31 and the base plate 32, faces towards the front wall 11 of the cover 1 for guiding an air current generated by a cooling fan 7 of the compressor unit to enter the motor's housing 61 more smoothly. Furthermore, the cover 1 is provided with an upper wall 13 which has a concave bottom 130. The upper wall 13 is located behind and parallel to the front wall 11 of the cover 1.

Figure 3:
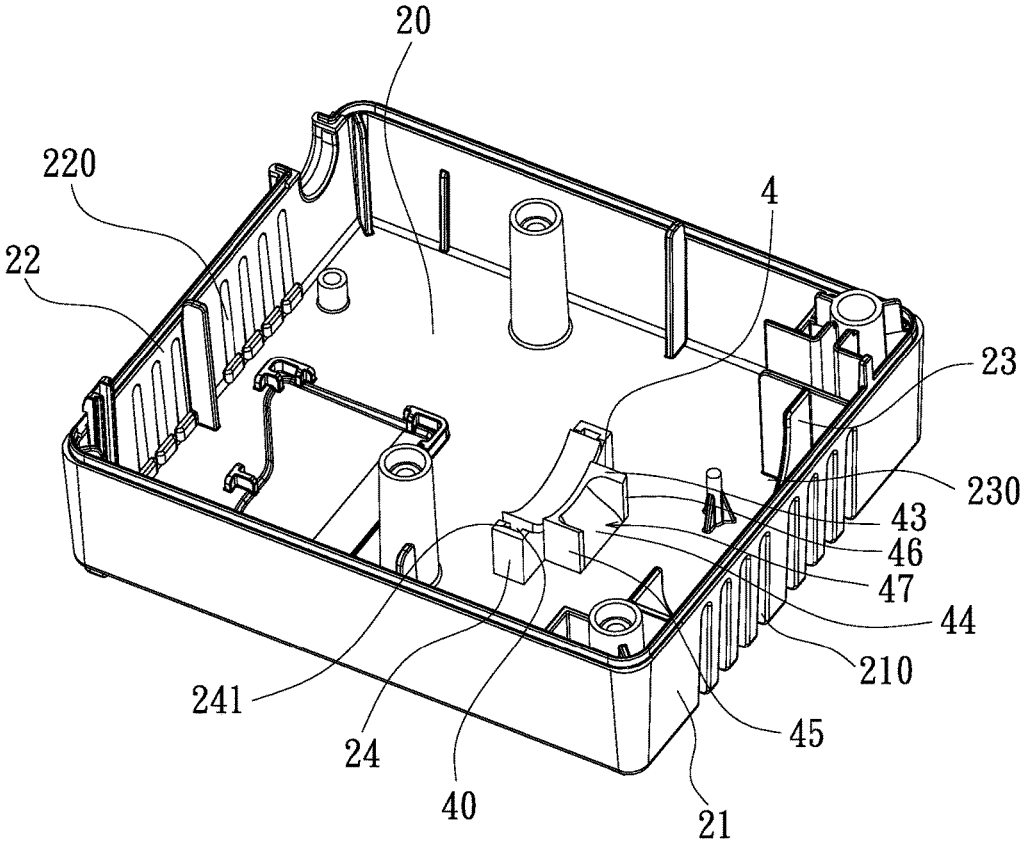
FIG. 3 shows a 3-dimensional view of the base of the box.

Referring to FIGS. 1 and 3, the base 2 has a rectangular board 20, a front wall 21 and a rear wall 22 opposite to the front wall 21. When the base 2 is combined with the cover 1 to form the box, the front wall 21 of the base 2 is aligned with the front wall 11 of the cover 1, while the rear wall 22 of the base 2 is aligned with the rear wall 12 of the cover 1. The front wall 21 of the base 2 defines multiple first slits 210 to serve as an air entrance port, while the rear wall 22 of the base 2 defines multiple second slits 220 to serve as an air exit port. The rectangular board 20 is provided with two opposite, lower fixing columns 24, each of which defines a channel 241, for engaging with a lower airflow-guiding member 4, which is similar to the upper airflow-guiding member 3. The lower airflow-guiding member 4 has an intercepting wall 41 of a predetermined height, two lateral walls 45, 46, a base plate 42, and a curved portion 43 (see also FIG. 6). The two lateral walls 45, 46 respectively extend from two opposite sides of the intercepting wall 41, towards the front wall 21 of the base 2. The intercepting wall 41 is farther to the front wall 21 of the base 2 than its adjacent lateral walls 45, 46. The base plate 42 is formed between one end of the intercepting wall 41 and the lateral walls 45, 46. The curved portion 43, conforming to the curvature of the motor's housing 61 of the compressor unit, is formed opposite to the base plate 42. The lower airflow-guiding member 4 is formed with two opposite ribs 40, which respectively extend from the two lateral sides 45, 46 and are substantially perpendicular to the two lateral sides 45, 46. The two opposite ribs 40 can engage in the channels 241 of the two lower fixing columns 24 and support the curved portion 43, so that the lower airflow-guiding member 4 can be fixed onto the base 2, and the curved portion 43 thereof can be used to support the motor's housing 61 of the compressor unit. The lower airflow-guiding member 4 is engaged with the lower fixing columns 24 such that the base plate 42 of the lower airflow-guiding member 4 is brought in contact with the rectangular board 20 of the base 2. A lower air guiding channel 47 is defined between the intercepting wall 41, the two lateral walls 45, 46 of the lower airflow-guiding member 4, and the base plate 42 of the lower airflow-guiding member 4. A lower slant surface 44, which is formed between the intercepting wall 41 and the base plate 42, faces towards the front wall 21 of the base 2 for guiding the air current generated by the cooling fan 7 to enter the motor's housing 61 more smoothly. Furthermore, the base 2 is provided with a lower wall 23 which has a concave top 230. The lower wall 23 is located behind and parallel to the front wall 21 of the base 2.

Although the compressor unit is not the main feature of the present invention, the basic elements of the compressor unit will be briefly described below for a better understanding of the technical contents of the present invention. Referring to FIGS. 1 through 5, the compressor unit, which is installed between the cover 1 and the base 2, generally includes a main frame 5, a cylinder 51 fitted with a piston body 85 and provided at the main frame 5, a transmission mechanism, the cooling fan 7, and the motor 6 which can drive the transmission mechanism to have the piston body 85 conduct reciprocating motion in the cylinder 51. The transmission mechanism includes a pinion 81, a gear 82 engaged with the pinion 81, and a counterweight 83 (see FIG. 7). In the motor's housing 61, there is provided a rotor assembly 64 (see FIG. 5), which includes a rotating shaft 60, an iron core 65 wound with enameled wire 66, a commutator 67, electrical terminals 68, and a brush unit 69. One end of the rotating shaft 60 is fitted with the cooling fan 7, and an opposite end of the rotating shaft 60 is fitted with the pinion 81. The motor's housing 61 defines two opposite openings 621, 622 at its circumferential wall, and a plurality of downstream through holes 63 (see also FIG. 5). The counterweight 83 is attached to the gear 82 and provided with a crankshaft and a crankpin 84, wherein the crankshaft is inserted through the gear 82 and rotatably connected to the main frame 5, while the crankpin 84 is pivotally connected to one end of the piston body 85. When the compressor unit is installed between the cover 1 and the base 2, the motor's housing 61 can be located between the upper and lower airflow-guiding members 3, 4 (see also FIGS. 5 and 6), wherein the curved portions 33, 43 of the upper and lower airflow-guiding members 3, 4 can support the motor's housing 61 properly, so that the motor 6 can be prevented from being loose, tilting or tipping over. The motor 6 can be started to rotate the pinion 81, which in turn can rotate the gear 82 to have the piston body 85 conduct reciprocating motion in the cylinder 51.

Figure 4:
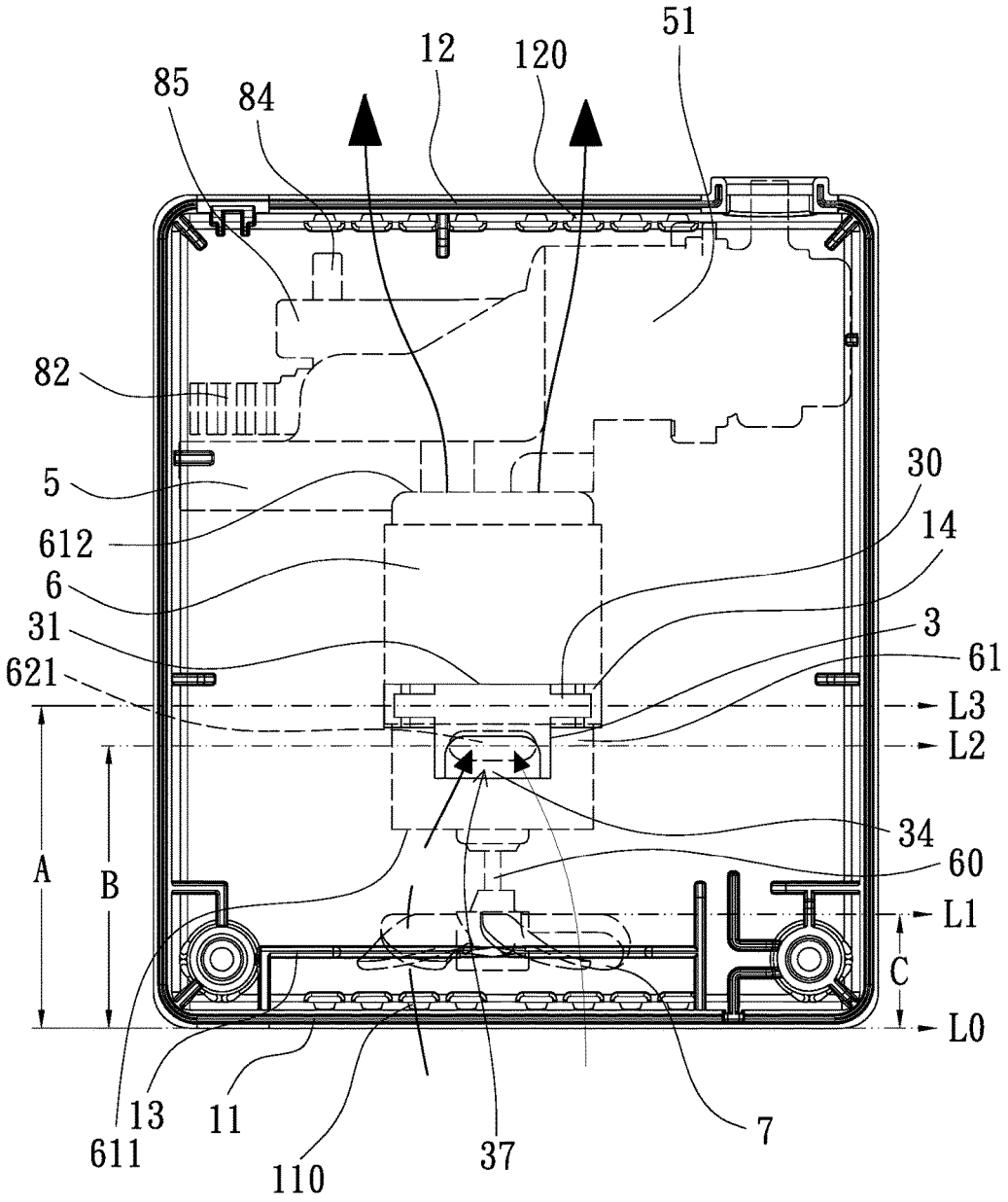
FIG. 4 shows a top view of the inflator, wherein the location of the compressor unit is manifested.

Referring to FIG. 4, the motor 6 is held between the upper and lower airflow-guiding members 3, 4 of the cover 1 and the base 2, wherein the outer surface of the front wall 11 or the front wall 21 is defined as a first reference line (L0). The cooling fan 7 is fitted at one end of the rotating shaft 16, near the front end 611 of the motor's housing 61. The rear end 612 of the motor's housing 61 is distal from the cooling fan 7. The back of the cooling fan 7 is defined as a second reference line (L1). The two opposite opening 621, 622 are located at one portion of the circumferential wall of the housing 61, near the front end 611 of the motor's housing 61. A central axis of the opening 621 or the opening 622, which is parallel to the front walls 11, 21, is defined as a third reference line (L2). A central axis of the two upper fixing columns 14 or the two lower fixing columns 24, which is parallel to the front walls 11, 21, is defined as a fourth reference line (L3). As shown, the distance between the first reference line (L0) and the fourth reference line (L3) is labeled with dimension (A); the distance between the first reference line (L0) and the third reference line (L2) is labeled with dimension (B); the distance between the first reference line (L0) and the second reference line (L1) is labeled with dimension (C); wherein the relationship of (A>B>C) is fulfilled. When the cooling fan 7 is rotated by the motor 6, outside air can be drawn into the box. In this embodiment, the air entrance port, which is formed as the first slits 110, 210, is provided at the front walls 11, 21. Of course, the air entrance port can be provided at other locations of the box as well, provided that it is located in front of the cooling fan 7, and between the first reference line (L0) and the second reference line (L1).

Figure 5:
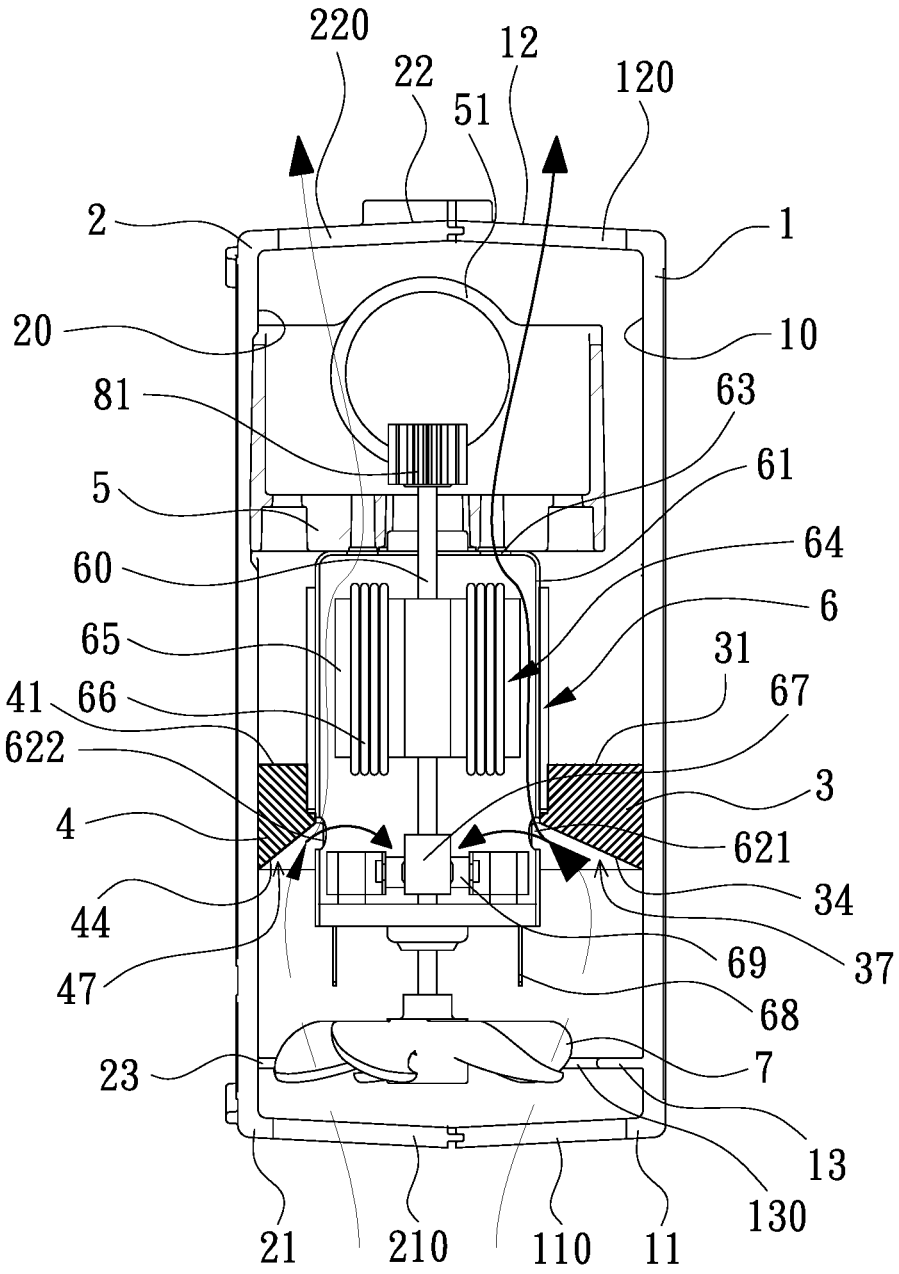
FIG. 5 shows a sectional view of the inflator
Figure 7:
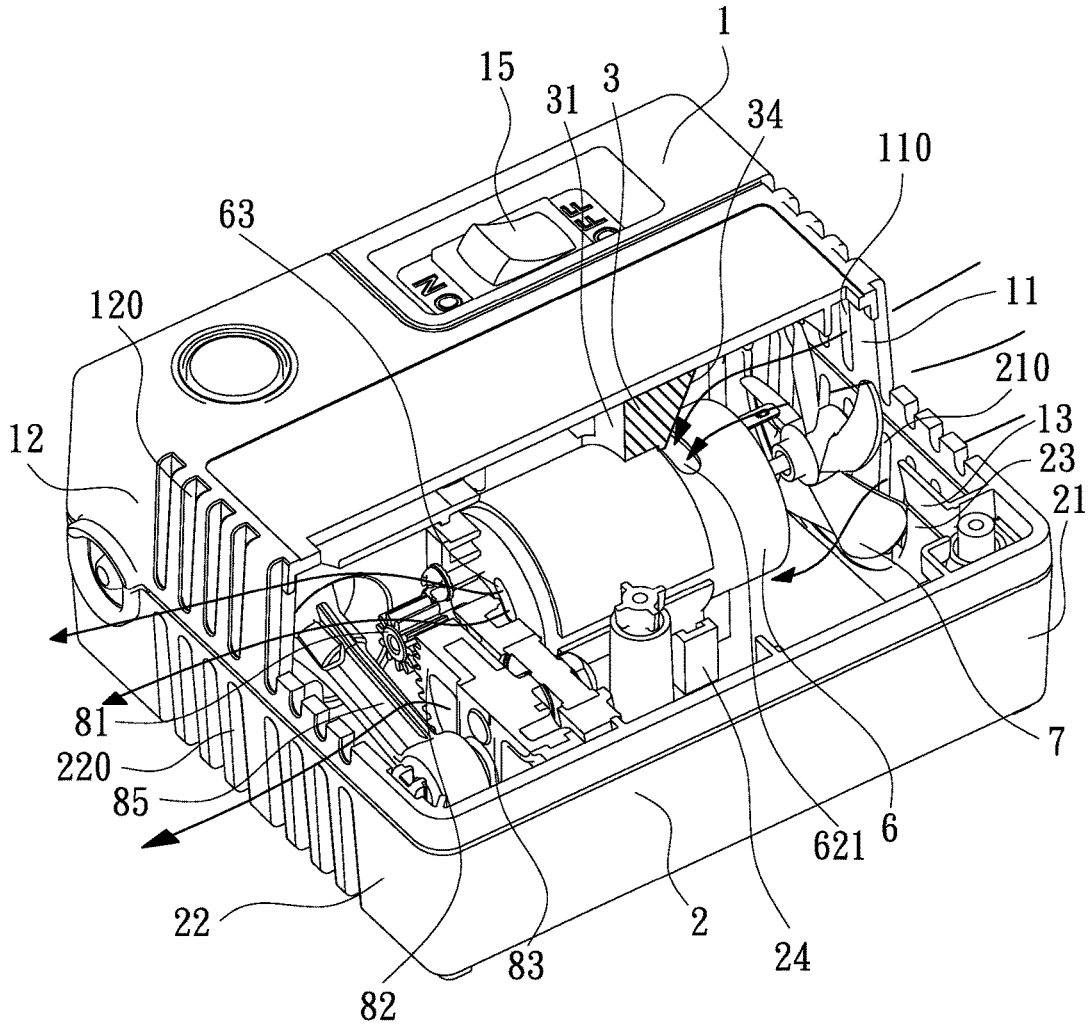
FIG. 7 shows a 3-dimensionally sectional view of the inflator, wherein the air current for dissipating heat is manifested.

FIGS. 4, 5 and 7 schematically show the air path of the inflator. As shown, when the cooling fan 7 is rotated by the motor 6, outside air can be drawn into the box to form an air current via the first slits 110, 210 of the front walls 11, 21 and the round opening, which is defined by the two concave parts 130, 230 of the upper and lower walls 13, 23. The upper and lower airflow-guiding members 3, 4 are disposed in contact with the motor's housing 61, wherein the two opposite openings 621, 622 are respectively within the upper and lower air guiding channels 37, 47 and respectively in front of the slant surfaces 34, 44 of the airflow-guiding members 3, 4, so that the air current can be guided by the slant surfaces 34, 44 to pass through the openings 621, 622 to enter the motor's housing 61 more easily, and then can flow out of the motor's housing 61 via the downstream through holes 63 thereof, and finally can flow out of the box via the second slits 120, 220 of the rear walls 12, 22. Therefore, the heat generated from the friction between the brush unit 69 and the commutator 67, and the heat generated from the electrical circulation in the enameled wire 66 can be taken away with the air current (see FIG. 5).

As a summary, the inflator of the present invention can solve the poor heat dissipation in conventional inflators. The inflator of the present invention is featured in that the cover 1 and the base 2 are respectively provided with the upper and lower airflow-guiding members 3, 4, which can quickly guide the air current generated by the cooling fan 7 to enter the motor's housing 61 via the two opposite openings 621, 622 of the housing 61 and then to flow out of the motor's housing 61 via the downstream through holes 63, thus taking away the heat generated by the rotor assembly 64 in the motor 6. Thus, heat is not easy to accumulate in the motor's housing, so that maximum power output of the motor can be achieved, and the performance and service life of the motor can be increased. In addition, the upper and lower airflow-guiding members 3, 4 can be used to firmly support the motor's housing between the cover 1 and base 2.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. An inflator including a box composed of a cover and a base, and a compressor unit installed in the box, wherein the cover has a board, a front wall and a rear wall opposite to the front wall, and the base has a board, a front wall aligned with the front wall of the cover, and a rear wall aligned with the rear wall of the cover, the front walls of the cover and the base defining multiple first slits to serve as an air entrance port, the rear walls of the cover and the base defining multiple second slits to serve as an air exit port, the compressor unit including a motor having a rotating shaft, one end of which is provided with a cooling fan, behind the front walls, for drawing outside air into the box to form an air current through the first slits, the motor defining two opposite openings and at least one downstream through hole on its housing; wherein the improvement comprises:

the cover is provided at its board with two opposite, upper fixing columns capable of engaging with an upper airflow-guiding member, while the base is provided at its board with two opposite, lower fixing columns, corresponding to the two upper fixing columns, capable of engaging with a lower airflow-guiding member, whereby the upper and lower airflow-guiding members immovably support the motor's housing of the compressor unit, and furthermore, the air current generated by the cooling fan can be guided by the upper and lower airflow-guiding members to enter the motor's housing via the two opposite openings and to flow out of the motor's housing through the at least one downstream through hole; wherein the upper airflow-guiding member has an intercepting wall, two lateral walls extending from two opposite sides of the intercepting wall thereof towards the front wall of the cover, a base plate formed between one end of the intercepting wall and the lateral walls, and a curved portion formed opposite to the base plate, an upper slant surface being formed between the intercepting wall and the base plate of the upper airflow-guiding member and facing towards the front wall of the cover, the upper airflow-guiding member capable of engaging with the upper fixing columns such that the base plate of the upper airflow-guiding member is brought in contact with the board of the cover, and an upper air guiding channel is defined between the intercepting wall, the two lateral walls of the upper airflow-guiding member, and the base plate of the upper airflow-guiding member; the lower airflow-guiding member has an intercepting wall, two lateral walls extending from two opposite sides of the intercepting wall thereof towards the front wall of the base, a base plate formed between one end of the intercepting wall and the lateral walls of the lower airflow-guiding member, and a curved portion formed opposite to the base plate of the lower airflow-guiding member, a lower slant surface being formed between the intercepting wall and the base plate of the lower airflow-guiding member and facing towards the front wall of the base, the lower airflow-guiding member capable of engaging with the lower fixing columns such that the base plate of the lower airflow-guiding member is brought in contact with the board of the base, and a lower air guiding channel is defined between the intercepting wall, the two lateral walls of the lower airflow-guiding member, and the base plate of the lower airflow-guiding member; wherein the two openings of the motor are respectively located within the upper and lower air guiding channels, whereby the upper and lower air guiding channels can guide the air current generated by the cooling fan to enter the motor's housing through the two openings, wherein the upper and lower slant surfaces of the upper and lower airflow-guiding members direct the air current towards the two openings; wherein a first reference line (L0) is defined at an outer surface of the front wall of the cover or the front wall of the base; a second reference line (L1) is defined at a back of the cooling fan in front of a front end of the motor; the two openings are defined at a portion of a circumferential wall of the motor's housing, near the front end of the motor, and a central axis of one of the two openings, being parallel to the front wall of the cover or the front wall of the base, is defined as a third reference line (L2); a central axis of the two upper fixing columns or the two lower fixing columns, being parallel to the front wall of the cover or the front wall of the base, is defined as a fourth reference line (L3); the distance between the first reference line (L0) and the fourth reference line (L3) is (A), the distance between the first reference line (L0) and the third reference line (L2) is (B), and the distance between the first reference line (L0) and the second reference line (L1) is (C), wherein the distances satisfy the relationship A>B>C; whereby outside air can be drawn into the box through the first slits and then be guided by the upper and lower airflow-guiding members to enter the motor's housing through the two openings, and subsequently flow out of the motor's housing through the at least one downstream through hole, and eventually flow out of the box through the second slits, thus taking away the heat generated in the motor.

2. The inflator of claim 1, wherein each of the two upper fixing columns defines a channel, and the upper airflow-guiding member is formed with two opposite ribs capable of engaging in the channels of the two upper fixing columns and supporting the curved portion of the upper airflow-guiding member for allowing the upper airflow-guiding member to be fixed onto the cover; each of the two lower fixing columns defines a channel, and the lower airflow-guiding member is formed with two opposite ribs capable of engaging in the channels of the two lower fixing columns and supporting the curved portion of the lower airflow-guiding member for allowing the lower airflow-guiding member to be fixed onto the base; whereby the motor's housing can be immovably supported by the curved portions of the upper and lower airflow-guiding members; wherein the cover is provided with an upper wall which has a concave bottom and is located behind and parallel to the front wall of the cover, the base is provided with a lower wall which has a concave top and is located behind and parallel to the front wall of the base.

* * * * *